US007097376B2

(12) United States Patent
Beretta

(10) Patent No.: US 7,097,376 B2
(45) Date of Patent: Aug. 29, 2006

(54) SCRAPING SEALING DEVICE FOR CLEANING STEMS AND BRISTLES OF APPLICATORS

(75) Inventor: Paolo Beretta, Sirtori (IT)

(73) Assignee: P & C S.R.L., Merate (IT)

( * ) Notice: Subject to any disclaimer, the term of this patent is extended or adjusted under 35 U.S.C. 154(b) by 229 days.

(21) Appl. No.: 10/781,002

(22) Filed: Feb. 18, 2004

(65) Prior Publication Data

US 2004/0170463 A1 Sep. 2, 2004

(30) Foreign Application Priority Data

Feb. 28, 2003 (IT) ..... MI20030090 U

(51) Int. Cl.
*A46B 11/00* (2006.01)
*A46B 17/08* (2006.01)

(52) U.S. Cl. ..... 401/122; 401/121

(58) Field of Classification Search ..... 401/121, 401/122, 126, 127

See application file for complete search history.

(56) References Cited

U.S. PATENT DOCUMENTS 565,328 A * 8/1896 Buhler ..... 401/122
2,627,619 A * 2/1953 Wilfrid ..... 401/122
3,469,928 A * 9/1969 Wildegren ..... 401/122
3,554,657 A * 1/1971 Aston ..... 401/122
4,784,505 A * 11/1988 Dahm ..... 401/122
5,284,239 A * 2/1994 Kiricoples ..... 401/122
5,599,125 A * 2/1997 Vasas et al. ..... 401/122
6,505,631 B1 * 1/2003 Fischer et al. ..... 401/122

* cited by examiner

*Primary Examiner*—Tuan Nguyen
(74) *Attorney, Agent, or Firm*—Notaro & Michalos PC

(57) ABSTRACT

A scraping sealing device for cleaning the stems and the bristles of liquid or pasty cosmetic product applicators, comprising a substantially cylindrical body of flexible material, crossed by an axial hole, to be applied to the neck of a container; the body showing a terminal section having a substantially truncated conical layout, wherein the outer wall of the terminal section, which reaches the applicator, forms with the device axis an angle different from 90 degrees, the device wall tapering in the terminal section until null thickness at the the edge is encountered.

The device makes an exhaustive cleaning of the stem when the latter is extracted from the bottle. It completely removes the exceeding contents present on the bristles and when the applicator is again inserted into the bottle, the device makes an efficacious hydraulic seal around the stem body, that avoids the product from drying.

16 Claims, 1 Drawing Sheet

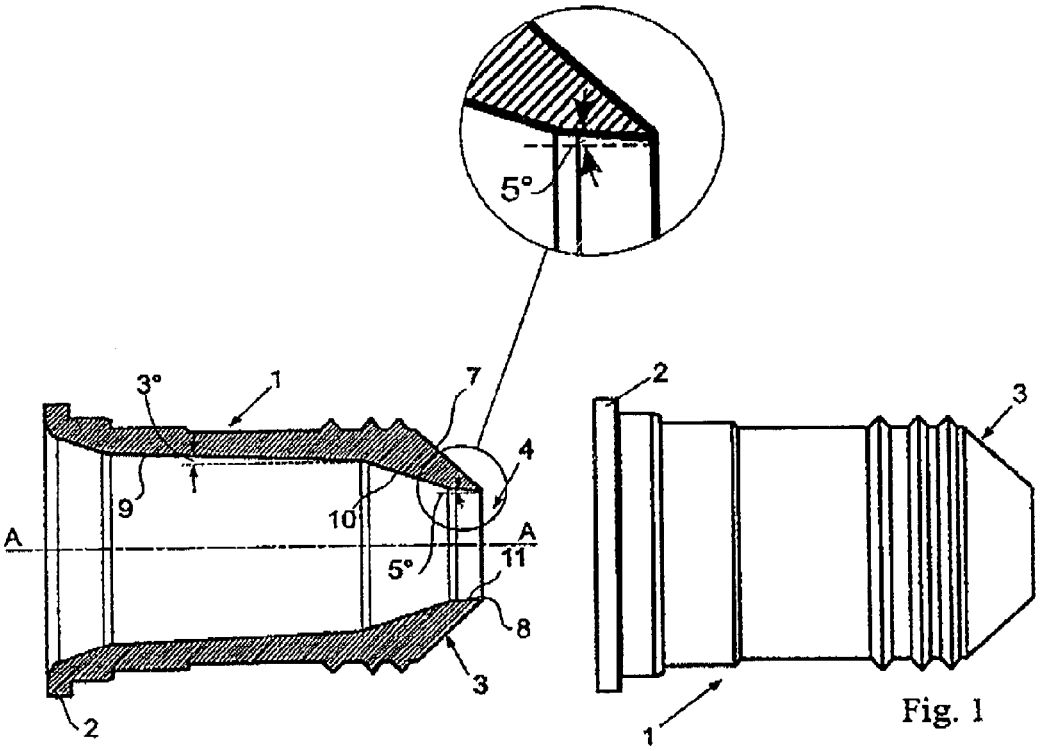
Fig. 2
Fig. 1
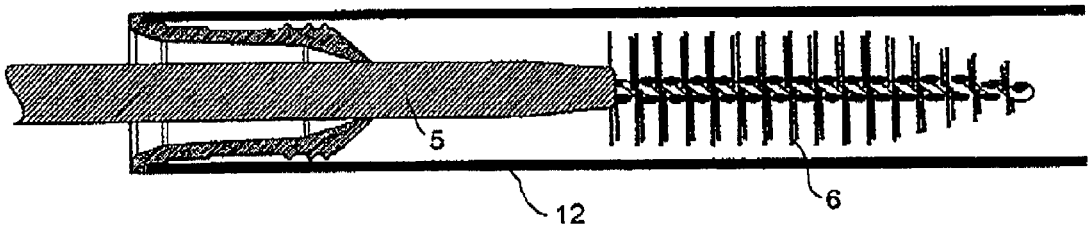
Fig. 3
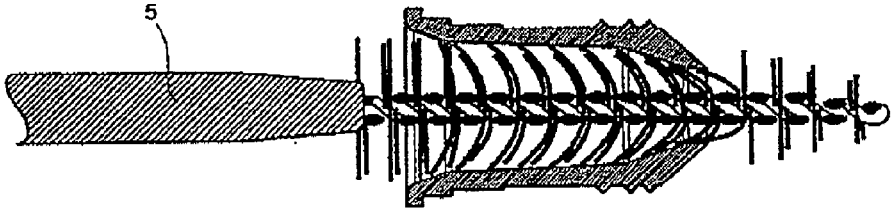
Fig. 4

SCRAPING SEALING DEVICE FOR CLEANING STEMS AND BRISTLES OF APPLICATORS

This invention proposes a scraping sealing device to be applied to the neck of containers of cosmetic products, whether liquid or pasty, which can make an efficacious cleaning of the stem and the bristles of the applicators used for this kind of products.

This invention concerns also the cosmetic product containers provided with this device.

The device according to the invention substantially consists of an axially hollow cylindrical body, of flexible plastic material, which shows an end with a substantially truncated conical form with its wall tapering towards the stem through hole, where the thickness reduces to zero.

The outer wall of this truncated conical section shows an inclination of about 45 degrees with respect to the device axis, while in the inner portion the terminal lip is slightly conical with a conicity of few degrees.

This layout allows to obtain a particularly efficacious device, which makes an exhaustive cleaning of the stem when the stem is extracted from the bottle, completely removes the exceeding contents present on the bristles and when the applicator is again inserted into the bottle, makes an efficacious hydraulic seal around the stem body, which prevents the product from drying.

As it is known the containers of liquid or pasty cosmetic products to be applied through a brush—a classic example is the mascara—are provided, in correspondence with the mouth, with a device which serves to remove the exceeding material from the stem and the brush bristles.

These devices generally consist of a cylindrical body of plastic material which is inserted into the bottle neck and which shows an axial hole with sizes lightly greater than the stem, so that when the stem is extracted, the exceeding material is removed following the engagement with the device wall.

In particular devices are known apt to remove the exceeding product from the stem and the bristles of an applicator, consisting of a hollow cylindrical body of stiff plastic material and which show at the top a truncated conical section which ends with a wall substantially orthogonal with respect to the device axis and therefore to the applicator stem axis.

The wall of these devices, also in correspondence with the hole through which the applicator is introduced and extracted, shows a certain thickness, 6–8 tenth of millimetres upwards.

This invention fits into this sector and concerns a device to remove the exceeding product from an applicator of the aforesaid type.

The known devices are in fact insufficiently efficacious, since they do not succeed in fully cleaning the stem, they do not completely remove the exceeding material from the bristles and above all they do not make a perfect hydraulic seal, when the container is closed.

These drawbacks and these restrictions are due to the layout of these devices, which reduces the efficacy thereof.

In the known devices it is in fact necessary to make the hole lightly greater than the stem diameter, since owing to the wall thickness and the stiffness of the material the device is made of, should the hole have a diameter exactly equal to the stem one, jamming would take place, preventing the free sliding thereof.

The necessity to let a certain play between the hole wall and the stem anyway prevents to obtain a perfect hydraulic seal when the bottle is closed again, with the risk that a part of the product escapes and stains the handbag where the product is placed and the consequent necessity to make the seal on the edge of the bottle neck, thereby involving another drawback. In this kind of containers, in fact, teeth are foreseen which are forced obtaining the full snap closure of the cover, so that the bottle is well closed and there is no risk that the product can escape; this feature is not anyway usually consistent with a front sealing system on the bottle neck. At last, the fact to provide for a wall section substantially orthogonal with respect to the stem axis, at the end of the truncated-conical section, is the cause of an additional drawback.

In fact, when the applicator is extracted, the quantity of material which is removed from the stem deposits on this section of horizontal wall, accumulating more and more thereon and creating thereby a kind of channel which causes that a greater and greater quantity of product adheres with the reduction of the scraping effect.

These drawbacks are now solved by the device according to the invention which, thanks to the particular layout of its parts, makes a complete and efficacious removal of the exceeding material from the stem surface, without this material tends to deposit on the outer surface of the device.

Furthermore the device results to be sufficiently flexible to allow the making of a hole for the introduction of the applicator with a diameter not greater than the stem, securing thereby each time a complete cleaning and guaranteeing a perfect hydraulic seal at the container closure.

These and other features can be better comprised from the detailed description which follows, supplied by way of a not limitative example, with reference to the enclosed figures, wherein:

FIG. 1 shows the device according to the invention;

FIG. 2 is a section of the device of FIG. 1;

FIGS. 3 and 4 show the cleaning device of the stem and the bristles according to the invention, during two following phases of introduction of the applicator.

With reference to FIG. 1, the device according to the invention substantially consists of a cylindrical body under the reference 1, which shows at one of its ends an edge 2 apt to lean on the neck of a bottle or a container of product and from the opposite end a truncated conical end 3.

The device 1 is axially hollow and shows, at its truncated-conical end, a hole 4 through which the applicator is introduced and extracted, consisting of a stem 5 provided, at its ends, with a plurality of bristles 6 for the collection of the product to be applied.

The applicator is inserted and extracted from the bottle through the hole 4 and the engagement with the wall of the device 1 in correspondence with this hole removes the quantity of exceeding product from the stem 5 and the bristles 6.

Furthermore, as it can be better seen later on, the device according to the invention, thanks to the particular layout given, is able to tightly close against the stem body, preventing the product from drying and escaping from the container 12.

With reference to FIG. 2, the truncated conical portion 3 shows the outer wall 7 in a non-orthogonal position with respect to axis A—A of the device. In particular the wall 7 shows an inclination comprised between 30° and 60°, preferably an inclination of about 45 degrees.

The thickness of the wall in the truncated conical section of the device is not constant but decreases as it is proceeded from the edge 2 to the hole 4 for the applicator introduction until to reach zero in correspondence with the edge of the hole under reference no. 8.

The inner wall of the device shows a first section under reference 9 slightly conical, for example with a conicity comprised between 1 and 6 degrees and preferably a conicity of about 3 degrees, a second section under the reference 10 having a higher conicity for example 15 to 25 degrees and preferably of about 20 degrees and the last section near the edge 8, under the reference no. 11, even it with a light conicity comprised between 2 and 8 degrees, preferably of about 5 degrees.

The device will be made of flexible material, preferably plastic material such as polyethylene or a material with a similar elastic modulus.

This layout allows to obtain many advantages.

The form of the terminal section of the device, that is truncated conical with the sharp edge, avoids that the product, which is removed from the stem and the bristles when the applicator is extracted, accumulates on the device tip, setting and preventing the removal of the product in the following extractions.

The device results sufficiently flexible to allow the introduction of the applicator without an excessive effort, even if the hole 4 is made with sizes equal or slightly less than the stem. In this way, the device lip always scrapes against the stem when the latter is extracted, completely removing the product and avoiding thereby that a thin deposit layer remains on the applicator, as this takes place with the known devices owing to the clearance that it is necessary to let between the hole 4 and the stem.

At last, always the flexibility of the device besides to realize a good seal against the stem body allows that the pressure which is created inside the container when the applicator is inserted (due to the "piston" effect of the stem that is introduced) elastically strains the device lip by pressing it against the stem and closing thereby tightly the container.

During the use, when the applicator is extracted, the lip 8 slides in contact with the stem removing all the product, aided by the corner that the wall 7 forms with the applicator itself.

At the end, when the bristles, which elastically strain, are extracted, the lip removes only the exceeding product.

Furthermore, the pressure increase due to the "piston" effect of the stem when the latter is introduced into the container through the hole 4 with the lip 8 in contact with the wall of the stem itself, causes an increase of the inner pressure, which thanks to the material flexibility and to the fact that the lip tapers near the edge, tightens even more the said lip around the stem body by realizing an hydraulic seal which avoids the product from escaping and prevents its drying.

In this way it is obtained a scraping sealing device for the cleaning of the stems and the bristles of applicators of pasty cosmetic products which, thanks to its particular layout, results more practical and comfortable to be used with respect to the known devices.

The sizes as well as the material used can vary according to the use needs.

The invention claimed is:

1. A device for cleaning an applicator of liquid or pasty cosmetic products, consisting of:

a substantially cylindrical body (1) having an axial hole (4) extending longitudinally through the center of the body (1), a terminal section (3), a device wall (9), a null thickness edge (8), and an outer surface;

the outer surface of the body being adapted for mating with the neck of a container;

the terminal section (3) comprising a substantially truncated conical layout, wherein the outer wall (7) of the terminal section forms an angle with respect to a device axis (AA) of between about 30° and 60°; and the terminal section (3) tapers off until the outer wall (7) and the device wall (9) converge at the null thickness edge (8).

2. A device according to claim 1, wherein the outer wall (7) forms an angle with respect to the device axis (AA) of about 45°.

3. A device according to claim 1, wherein the terminal section (3) comprises an inner wall (11) formed at a slight incline with respect to the device axis (AA).

4. A device according to claim 3, wherein the incline of the inner wall (11) forms an angle with respect to the device axis (AA) of between about 2° and 8°.

5. A device according to claim 4, wherein the incline of the inner wall (11) forms an angle with respect to the device axis (AA) of about 5°.

6. A device according to claim 1, wherein the device wall (9) is formed at a slight incline with respect to the device axis (AA), and wherein the incline of the device wall (9) forms an angle with respect to the device axis (AA) of between about 1° and 6°.

7. A device according to claim 6, wherein the incline of the device wall (9) forms an angle with respect the device axis (AA) of about 3°.

8. A device according to claim 1, wherein the lower portion (10) of the device wall (9) is formed at an incline with respect the device axis (AA) of between about 15° and 25°.

9. A device according to claim 8, wherein the the lower portion (10) of the device wall (9) is formed at an incline with respect the device axis (AA) of about 20°.

10. A device according to claim 1, further comprising an annular edge (2) on one end, adapted to rest on the neck of the container.

11. A device according to claim 1, wherein the diameter of the axial hole (4) at the null thickness edge (8) is equal to or less than the diameter of the stem of the applicator.

12. A device according to claim 11, wherein the device is made of polyethylene or flexible plastic material.

13. A scraping sealing device for cleaning of stems and bristles of applicators of liquid or pasty cosmetic products, comprising:

a substantially cylindrical body (1) formed of flexible material having an axial hole (4) extending longitudinally through the center of the body, an outer surface, a device wall (9) and a terminal section (3);

the outer surface of the body being adapted for mating with the neck of a container;

the terminal section (3) having a substantially truncated conical layout;

the outer wall (7) of the said terminal section (3) forms an angle with respect to a device axis (AA) of less than 90 degrees; and terminal section tapers off until the device wall (9) and the outer wall (7) converge at the null thickness edge (8);

wherein the terminal section (3) comprises an inner wall (11) formed at an incline with respect to the device axis (AA); and wherein the incline of the inner wall (11) forms an angle with respect to the device axis (AA) of between about 2° and 8°.

14. A container for cosmetic products comprising a device according to claim 1.

15. A container for cosmetic products comprising a device according to claim 13.

16. A device for cleaning an applicator of liquid or pasty cosmetic products, consisting of:

a substantially cylindrical body (1) having an axial hole (4) extending longitudinally through the center of the body (1), a terminal section (3), a device wall (9), an annular edge (2) disposed on the upper portion of the body, a null thickness edge (8) disposed on the lower portion of the body, and an outer surface;

the outer surface of the body being adapted for mating with the neck of a container;

the annular edge (2) being adapted to rest on the neck of the container;

the terminal section (3), comprising:

a substantially truncated conical layout; wherein the outer wall (7) of the terminal section forms an angle with respect to a device axis (AA) of between about 30° and 60°; wherein the terminal section (3) tapers off until the outer wall (7) and the device wall (9) converge at the null thickness edge (8);

an inner wall (11) formed at an incline with respect to the device axis (AA), wherein the incline of the innerwall (11) forms an angle with respect to the device axis (AA) of between about 2° and 8°;

wherein the lower portion (10) of the device wall (9) is formed at an incline with respect the device axis (AA) of between about 15° and 25°;

wherein the diameter of the axial hole (4) at the null thickness edge (8) is equal to or less than the diameter of the stem of the applicator.

* * * * *